US008262214B2

(12) United States Patent
Doo

(10) Patent No.: US 8,262,214 B2
(45) Date of Patent: Sep. 11, 2012

(54) INK JET PRINTER

(75) Inventor: Harumichi Doo, Hamamatsu (JP)

(73) Assignee: LG Electronics Inc., Seoul (KR)

( * ) Notice: Subject to any disclaimer, the term of this patent is extended or adjusted under 35 U.S.C. 154(b) by 322 days.

(21) Appl. No.: 12/725,400

(22) Filed: Mar. 16, 2010

(65) Prior Publication Data

US 2010/0238247 A1 Sep. 23, 2010

(30) Foreign Application Priority Data

Mar. 17, 2009 (JP) ..... 2009-64242

(51) Int. Cl.
*B41J 2/01* (2006.01)

(52) U.S. Cl. ..... 347/102; 347/5; 347/14; 347/22; 400/621; 101/116; 101/117; 101/128.4

(58) Field of Classification Search ..... None
See application file for complete search history.

(56) References Cited

U.S. PATENT DOCUMENTS 6,076,460 A * 6/2000 Kagawa ..... 101/128.4
6,575,553 B1 * 6/2003 Williams et al. ..... 347/22
6,832,831 B2 * 12/2004 Shima et al. ..... 347/102
6,990,899 B2 * 1/2006 Kato ..... 101/117
7,232,212 B2 * 6/2007 Iwase ..... 347/102
7,794,076 B2 * 9/2010 Nakano et al. ..... 347/102
2007/0146458 A1 * 6/2007 Perego ..... 347/102

* cited by examiner

*Primary Examiner* — Matthew Luu
*Assistant Examiner* — John P Zimmermann
(74) *Attorney, Agent, or Firm* — Lee, Hong, Degerman, Kang & Waimey

(57) ABSTRACT

An ink jet recording apparatus includes a guide rail extending in a first direction; an ink head that slidably engages with the guide rail and discharges an ultraviolet light curable ink toward a recording medium; an ultraviolet light irradiation device attached to the ink head to move together with the ink head and that irradiates ultraviolet light to the ink discharged on the recording medium; a second head that slidably engages with the guide rail; a carriage that moves along the guide rail; a first connection mechanism that detachably connects the carriage with the ink head; a second connection mechanism that detachably connects the carriage with the second head; and an irradiation prohibition mechanism that prohibits the irradiation by the ultraviolet light irradiation device based on a predetermined condition relating to a connection state between the carriage and the ink head caused by the first connection mechanism.

13 Claims, 12 Drawing Sheets

(a)

(b)

INK JET PRINTER

Pursuant to 35 U.S.C. §119(a), this application claims the benefit of earlier filing date and right of priority to Japanese Patent Application No. 2009-64242, filed on Mar. 17, 2009, the contents of which are hereby incorporated by reference herein in its entirety.

BACKGROUND

1. Field

Embodiments of the present invention relate to an ink jet recording apparatus.

2. Discussion of the Related Art

Ink jet recording apparatuses equipped with an ink head that discharges ink onto a recording medium such as a sheet of recording paper and a cutting head that cuts the recording medium have conventionally been known. The ink head and the cutting head are engaged with a guide rail extending in a predetermined direction and are carried by a carriage that moves along the guide rail.

In an ink jet recording apparatus in which a carriage is built into a cutting head, the ink head and the cutting head are structured to be mutually and freely attachable and detachable. When a printing function by the ink head takes place, the cutting head and the ink head become connected. The ink head is then carried in the scanning direction in one piece with the cutting head by the carriage built into the cutting head. As the ink head moves in the scanning direction, it discharges ink droplets on the recording medium. The connection between the cutting head and the ink head is released when cutting the recording medium. The ink head then stands by at a predetermined standby position, i.e., a home position, and the cutting head alone is carried by the built-in carriage.

Also, an ink jet recording apparatus that uses ink curable upon irradiation of ultraviolet light (hereafter referred to as "ultraviolet light curable ink") as ink to be discharged from the ink head is known. The ink jet recording apparatuses that use the ultraviolet light curable ink are equipped with a device for irradiating ultraviolet light (hereafter referred to as an "ultraviolet light irradiation device") to cure the ink which has been discharged from the ink head on a recording medium. An ultraviolet light irradiation device that is attached to an ink head and carried in one piece with the ink head in the scanning direction is known. Such an ultraviolet light irradiation device is capable of irradiating ultraviolet light only on a necessary portion of the recording medium, thereby suppressing wasteful irradiation of ultraviolet light.

SUMMARY

According to one embodiment, an ink jet recording apparatus includes a guide rail extending in a first direction; an ink head that slidably engages with the guide rail and discharges an ultraviolet light curable ink toward a recording medium; an ultraviolet light irradiation device that is attached to the ink head to move together with the ink head and that irradiates ultraviolet light to the ultraviolet light curable ink discharged from the ink head onto the recording medium; a second head that slidably engages with the guide rail; a carriage that moves along the guide rail; a first connection mechanism that detachably connects the carriage with the ink head; a second connection mechanism that detachably connects the carriage with the second head; and an irradiation prohibition mechanism that prohibits the irradiation by the ultraviolet light irradiation device based on a predetermined condition relating to a connection state between the carriage and the ink head caused by the first connection mechanism.

According to one embodiment, an ink jet recording apparatus includes: a guide rail extending in a first direction; an ink head that slidably engages with the guide rail, and discharges an ultraviolet light curable ink toward a recoding medium; an ultraviolet light irradiation device that is attached to the ink head to move together with the ink head and that irradiates ultraviolet light to the ultraviolet light curable ink discharged from the ink head onto the recording medium; a second head that slidably engages with the guide rail; a carriage that moves along the guide rail; a first connection mechanism that detachably connects the carriage with the ink head; and a second connection mechanism that detachably connects the carriage with the second head. The second head is connected to and disconnected from the carriage at a home position located at an end of the guide rail, and stands by at the home position when the second head is not connected to the carriage, and is equipped with an irradiation prohibition mechanism that prohibits the irradiation by the ultraviolet light irradiation device based on a predetermined condition relating to a position of the second head.

BRIEF DESCRIPTION OF THE DRAWINGS

The above and other aspects and features of the present disclosure will become more apparent upon consideration of the following description of embodiments, taken in conjunction with the accompanying drawing figures:

FIG. 8(*b*) is a conceptual diagram showing a mechanism for detecting the positions of the carriage and the cutting head according to one embodiment.

DETAILED DESCRIPTION

According to a previous ink jet recording apparatus, the carriage must carry both the ink head and the cutting head, although the cutting head is unnecessary for printing with the ink head. This causes a greater load on the carriage. In particular, when the ultraviolet light irradiation device is attached to the ink head, the carriage must carry the ink head, the ultraviolet light irradiation device, and the cutting head, which leads to an even greater load on the carriage.

One way to address this issue is to have the carriage be independent of the cutting head, so that the carriage is connected only to the ink head when printing with the ink head, and the carriage is connected only to the cutting head when cutting the recording medium. However, even if such a new structure were to be used, the operational efficiency of the ink jet recording apparatus would not be improved as long as operations similar to conventional operations are carried out.

Embodiments of the present invention address such a problem, and aspects are directed to improve the operational efficiency of an ink jet recording apparatus equipped with a plurality of heads including an ink head for discharging ultraviolet light curable ink, and whose heads are carried independently of each other by a carriage.

According to embodiments of the present invention, it would be possible to improve the operational efficiency of an ink jet recording apparatus equipped with an ink head that discharges ultraviolet light curable ink and other heads, wherein the heads are carried independently of each other by a carriage.

In the following detailed description, reference is made to the accompanying drawing figures which form a part hereof, and which show by way of illustration specific embodiments of the invention. It is to be understood by those of ordinary skill in this technological field that other embodiments may be utilized, and structural, electrical, as well as procedural changes may be made without departing from the scope of the present invention. Wherever possible, the same reference numbers will be used throughout the drawings to refer to the same or similar parts.

Figure 1:
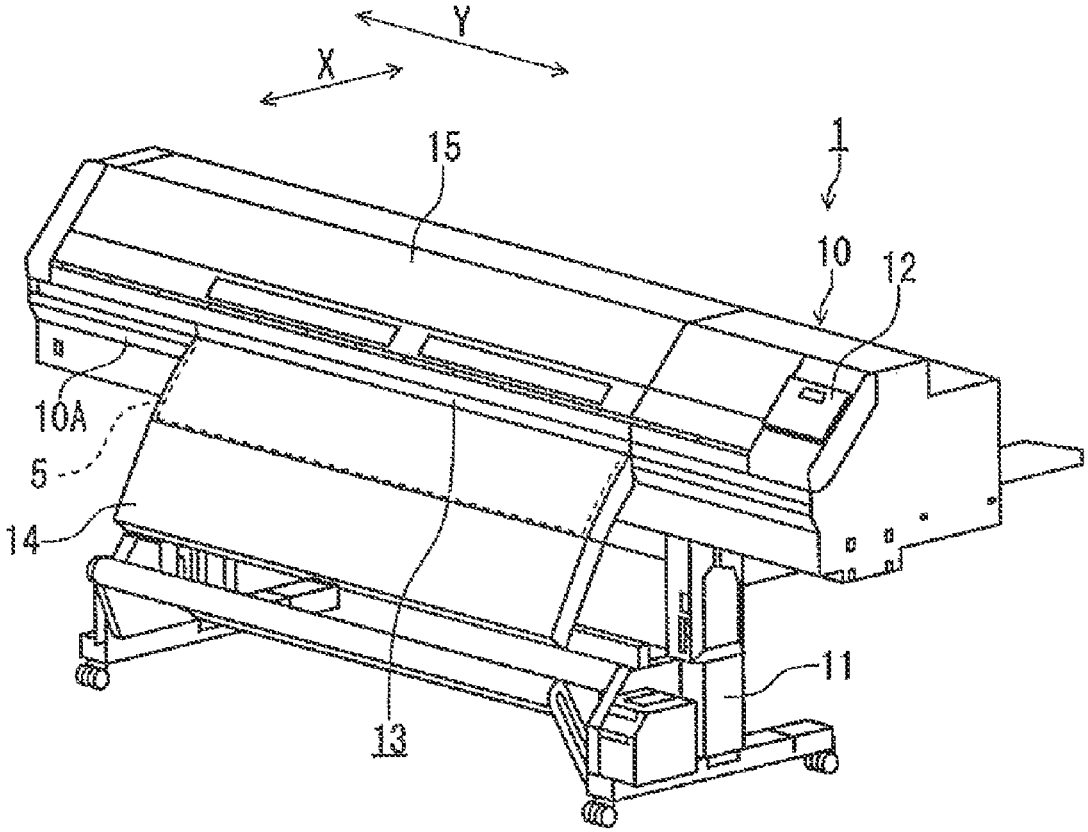
FIG. 1 is a perspective view of an ink jet printer according to one embodiment.

An ink jet recording apparatus in accordance with an embodiment of the invention may be an ink jet printer 1 with a cutting head, as shown in FIG. 1. The ink jet printer 1 is equipped with an ink head 40 and a cutting head 70, as described below (see FIG. 2). The ink jet printer 1 is capable of performing printing and cutting operations with respect to a sheet of recording paper 5. It is noted that an arrow Y shown in FIG. 1 indicates a primary scanning direction, and an arrow X indicates an auxiliary scanning direction that is a direction perpendicular to the primary scanning direction Y.

The ink jet printer 1 is provided with a main body 10 having a casing 10A that extends in the scanning direction Y, and legs 11 that support the main body 10. An operation panel 12 is provided on the right side of the main body 10.

The operation panel 12 may be equipped with a display section that displays operation states, a cursor key for designating the positions of the ink head 40 and the cutting head 70, a start region setting key for designating a region of a specified portion for which printing or cutting is to be started based on an image data signal, an operation start key for starting printing or cutting from the designated start region, and the like.

A front cover 15 that can be freely opened and closed is mounted on an upper portion of the main body 10. A discharge port 13 for discharging the recording paper 5 is formed in the main body 10 on its lower side. A guide 14 is provided at a position at the (or in) front of and below the discharge port 13 for guiding the recording paper 5 discharged from the discharge port 13 in a forwardly diagonal downward direction.

Figure 2:
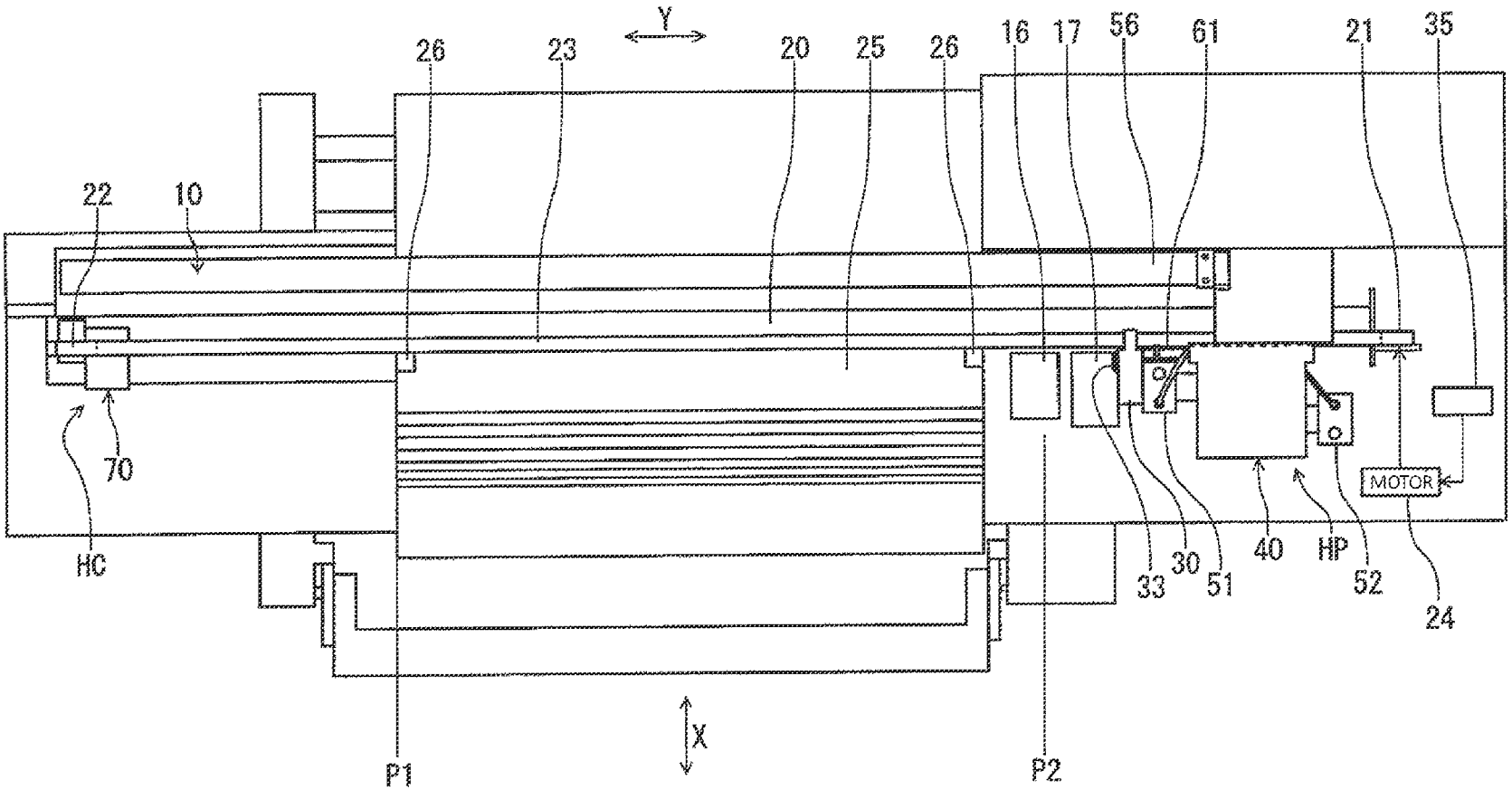
FIG. 2 is a plan view showing the internal structure of the ink jet printer according to one embodiment.

Next, the internal structure of the main body 10 shall be described according to one embodiment. As shown in FIG. 2, a guide rail 20 extending in the primary scanning direction Y is provided inside the main body 10. When the ink jet printer 1 is viewed from the front, the primary scanning direction Y corresponds to a left-right direction, and the auxiliary scanning direction X corresponds to a front-rear direction. Accordingly, in the following description, the primary scanning direction Y may be suitably referred to as the left-right direction, and the auxiliary scanning direction X may be suitably referred to as the front-rear direction. A platen 25 is disposed in a central area and at the front of the guide rail 20. The platen 25 is a part for supporting the recording paper 5 at the time of printing by the ink head 40 and at the time of cutting the recording paper 5 by the cutting head 70. Printing and cutting of the recording paper 5 are conducted on the platen 25.

Figure 4:
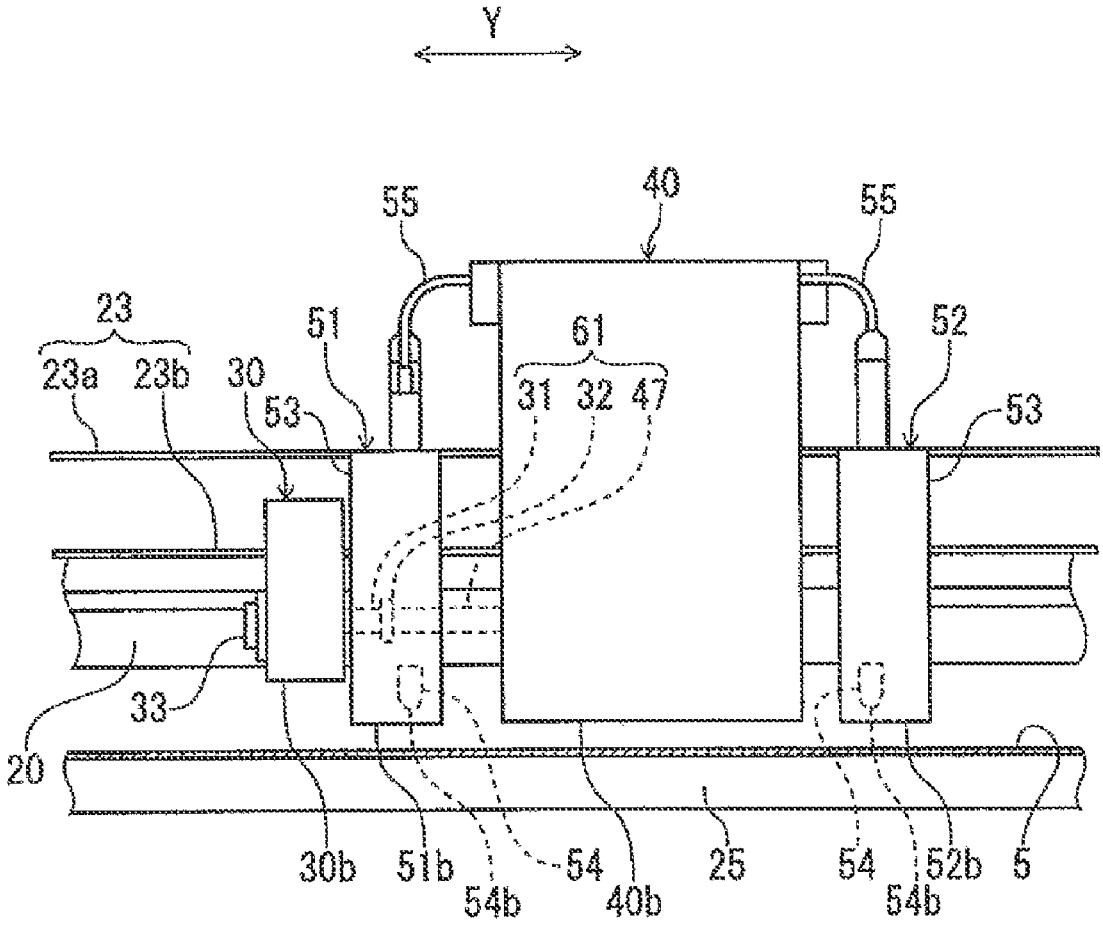
FIG. 4 is a front view showing the carriage and the ink head according to one embodiment.
Figure 5:
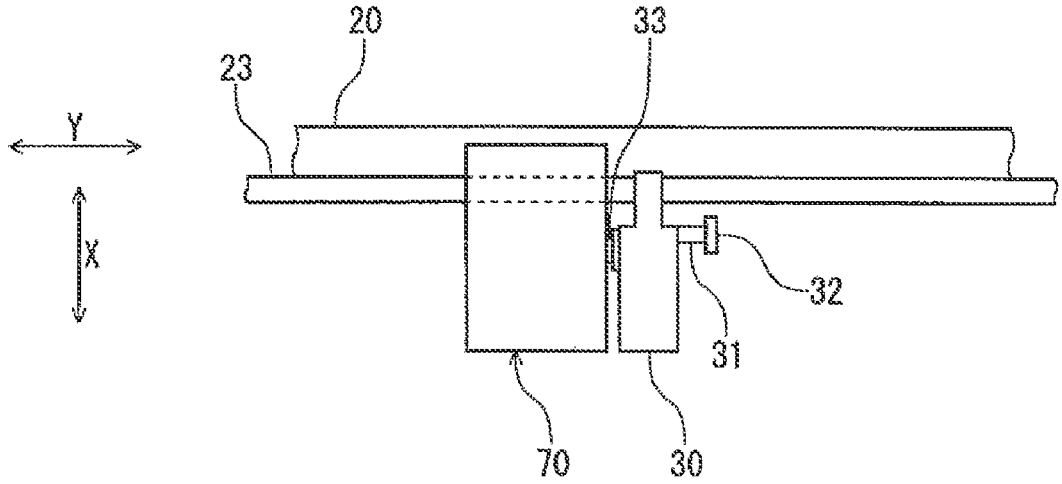
FIG. 5 is a plan view showing the carriage and a cutting head according to one embodiment.

A pulley 21 is provided adjacent to the right end section of the guide rail 20, and a pulley 22 is provided adjacent to the left end section of the guide rail 20. An endless belt 23 is wound around the pulley 21 and the pulley 22. In FIG. 4 and other drawings, the reference numeral 23*a* denotes an upper portion of the belt 23, and the reference numeral 23*b* denotes a lower portion of the belt 23. Referring back to FIG. 2, a servo motor 24 is connected to the pulley 21. When the servo motor 24 drives the pulley 21, the belt 23 is driven between the pulley 21 and the pulley 22. A control device 35 is communicably connected to the servo motor 24. The servo motor 24 is a motor that can be freely rotated in forward and reverse directions. The control device 35 controls the servo motor 24, thereby controlling movements of a carriage 30 to be described below. It is noted that, in accordance with the present embodiment, it is the pulley 21 that is driven, but it is understood that the pulley 22 may be driven instead.

Figure 3:
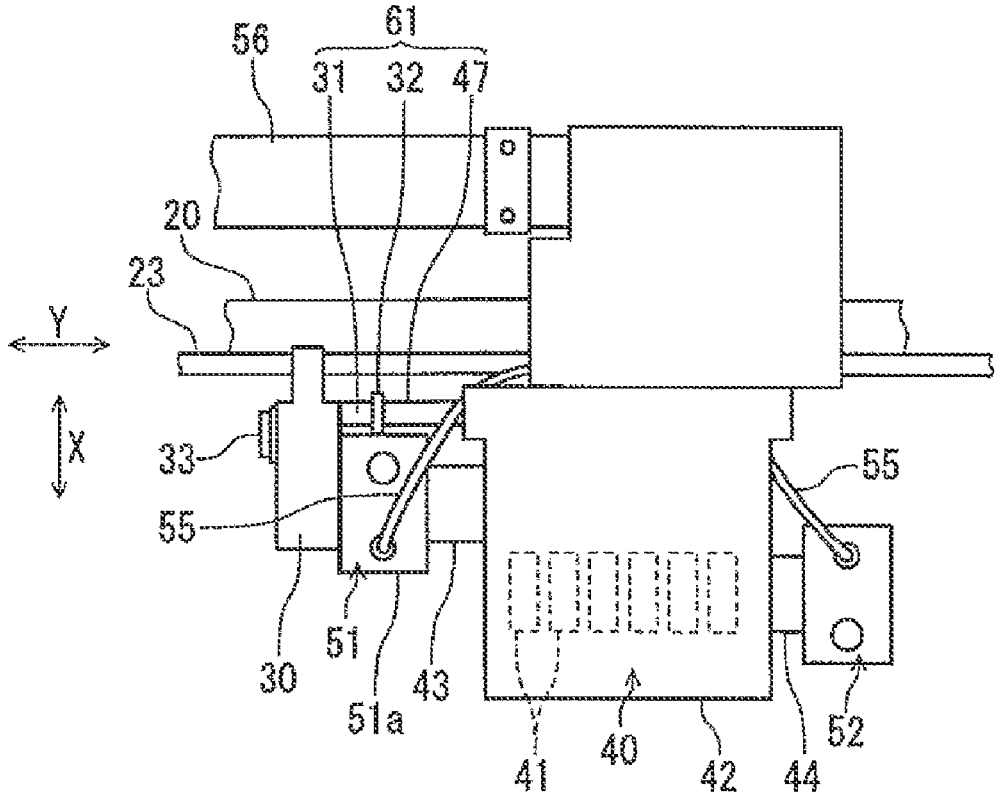
FIG. 3 is a plan view showing a carriage and an ink head according to one embodiment.

The carriage 30 is mounted on the belt 23 and engaged with the guide rail 20. Consequently, the carriage 30 moves in the left-right direction when the belt 23 is driven. As shown in FIG. 3, a connection member 31 extending to the right is fixed to the right side of the carriage 30. According to one embodiment, the connection member 31 is disposed posterior to the center position of the carriage 30 in the front-rear direction. A magnet 32 is attached to the right end section of the connection member 31. A magnet 33 is attached to the left side of the carriage 30. The connection member 31, the magnet 32, and the magnet 33 may be either separate from the carriage 30 or integrated with it. The connection member 31, the magnet 32, and the magnet 33 may be structural elements not clearly distinguishable in appearance from the carriage 30. The connection member 31, the magnet 32, and the magnet 33 move in one piece with the carriage 30. For this reason, the carriage 30, the connection member 31, the magnet 32, and the magnet 33 may collectively be referred to as a "carriage." However, the carriage 30 is distinguished from the connection member 31, the magnet 32, and the magnet 33 in the present specification for purposes of description.

As shown in FIG. 2, a pair of upper and lower rollers 26 is provided at each of the left end section and the right end section of the platen 25 for feeding the recording paper 5 in the auxiliary scanning direction X. It is noted that FIG. 2 illustrates only the upper rollers. Among the pair of upper and lower rollers 26, one of the rollers 26 is a driving roller that rotates itself, and the other of the rollers 26 is a pinching roller for pinching the recording paper 5 with the driving roller. It is noted that the operation of the driving rollers is controlled by the control device 35. These rollers 26 form a transfer mechanism that transfers the recording paper 5 in the auxiliary scanning direction X. It is noted that the positions of the pair of upper and lower rollers 26 may not be limited, in particular, to the left end section and the right end section of the platen 25.

Next, the ink head 40 shall be described. The ink head 40 is a head that ejects ink toward the recording paper 5. With reference to FIG. 3, the ink head 40 has a plurality of print heads 41 each having nozzles for ejecting ink, and a print head carriage 42 that supports the print heads 41. The print head carriage 42 engages with the guide rail 20 in a manner freely moveable in the left-right direction. The print heads 41 eject ink droplets downward from the nozzles. An ink cartridge filled with ink is attached to the rear portion of the main body 10. The print heads 41 are connected to the ink cartridge through tubes. Ink is supplied to the print heads 41 from the ink cartridge described above. It is noted that the ejection operation of the ink head 40 is also controlled by the control device 35.

The ink head 40 ejects ink that is cured when irradiated with ultraviolet light, in other words, the ink head 40 ejects ultraviolet light curable ink. The ink jet printer 1 is equipped with first and second ultraviolet light LEDs 51 and 52 as ultraviolet light irradiation devices. The first ultraviolet light LED 51 is mounted to the left side of the print head carriage 42 through a connection member 43. The second ultraviolet light LED 52 is mounted to the right side of the print head carriage 42 through a connection member 44. According to one embodiment, the first ultraviolet light LED 51 and the second ultraviolet light LED 52 are disposed at positions mutually shifted (or offset from each other) in the front-rear direction. According to other embodiments, the first ultraviolet light LED 51 may be disposed in front of the second ultraviolet light LED 52, or both of the ultraviolet light LEDs 51 and 52 may be at the same position in the front-rear direction.

As shown in FIG. 4, the first ultraviolet light LED 51 is equipped with a case 53, a plurality of light emitting elements 54 provided inside the case 53, and a cable 55 for supplying electricity to the light emitting elements 54. The cable 55 is connected to a power supply through the cableveyor 56 (see FIG. 2). The second ultraviolet light LED 52 has a similar structure as that of the first ultraviolet light LED 51. The light emitting operation of both of the ultraviolet light LEDs 51 and 52 is also controlled by the control device 35.

The ultraviolet light LEDs 51 and 52 are closer to the platen 25 than the carriage 30. In other words, a bottom end 30*b* of the carriage 30 is positioned higher than respective bottom ends 51*b* and 52*b* of the ultraviolet light LEDs 51 and 52. In addition, the bottom end 30*b* of the carriage 30 is positioned higher than bottom ends 54*b* of the light emitting elements 54 of the ultraviolet light LEDs 51 and 52. Moreover, the bottom end 30*b* of the carriage 30 is positioned higher than a bottom end 40*b* of the ink head 40.

As shown in FIG. 3, a connection member 47 extending to the left is provided to the left and rear of the print head carriage 42. The connection member 31 is shorter than the connection member 47 in the left-right direction. The connection member 47 may be integrated with the print head carriage 42 or may be separate. At least the left end section of the connection member 47 is formed with a magnetic material. For this reason, when the magnet 32 comes in contact with the connection member 47, the connection member 47 is attracted by the magnet 32. As a result, the carriage 30 and the ink head 40 become connected to each other through the connection member 31, the magnet 32, and the connection member 47. When the belt 23 is driven with the ink head 40 fixed and a leftward force is applied to the carriage 30, the magnet 32 is separated from the connection member 47. In other words, when the ink head 40 is fixed to the main body 10 at a home position HP (see FIG. 2) to be described below and the carriage 30 moves to the left, the connection between the carriage 30 and the ink head 40 is released. In this way, the connection member 31, the magnet 32 and the connection member 47 form a first connecting mechanism 61 that freely detachably couples the carriage 30 with the ink head 40. The first connecting mechanism 61 extends in the left-right direction to span between the carriage 30 and the ink head 40.

Figure 6:
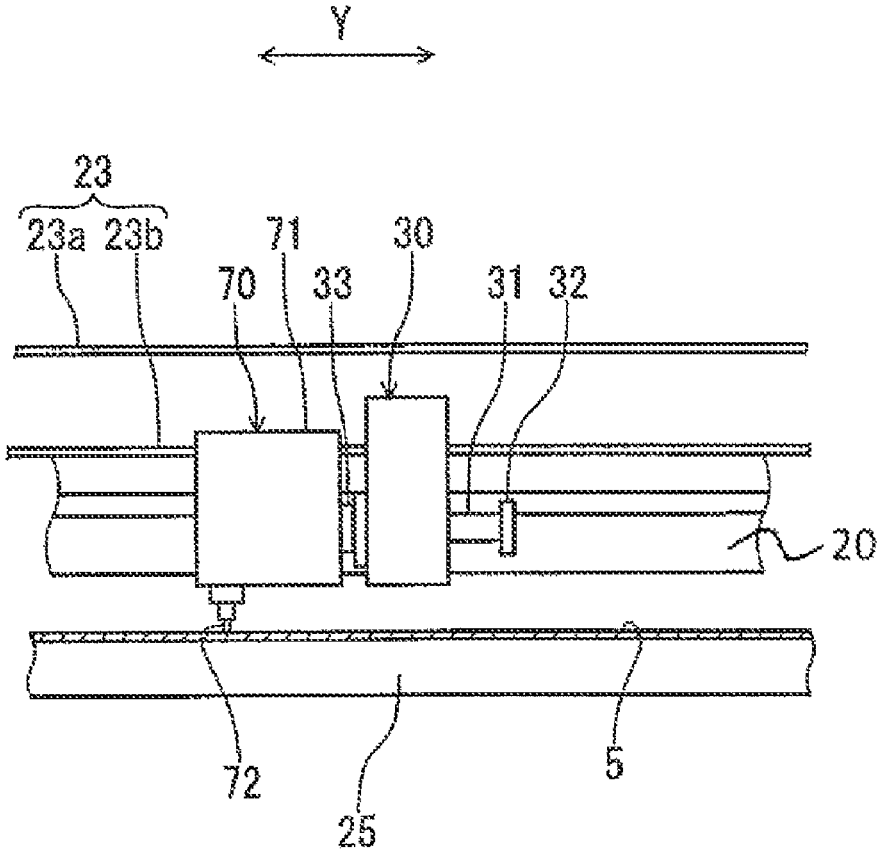
FIG. 6 is a front view showing the carriage and the cutting head according to one embodiment.

Next, the cutting head 70 will be described. The cutting head 70 is a head for cutting the recording paper 5. When the recording paper 5 is cut out, the cutting head 70 is moved by the carriage 30 in the primary scanning direction Y, while the recording paper 5 is moved by the rollers 26 in the auxiliary scanning direction X. Through such movements, the cutting head 70 can cut the recording paper 5 in a two-dimensional manner, and an arbitrary portion of the recording paper 5 can be cut or cut out. As shown in FIG. 6, the cutting head 70 is equipped with a cutter 72 and a case 71 that supports the cutter 72. The case 71 engages with the guide rail 20. Consequently, the cutting head 70 is guided by the guide rail 20 along the primary scanning direction Y.

At least a part of the case 71 that opposes the magnet 33 is formed with a magnetic material. For this reason, when the magnet 33 provided on the carriage 30 comes into contact with the case 71, the case 71 is attracted by the magnet 33. As a result, the carriage 30 and the cutting head 70 become connected to each other through the magnet 33. Conversely, when the belt 23 is driven with the cutting head 70 at a fixed position and a rightward force is applied to the carriage 30, the magnet 33 is separated from the case 71. In other words, when the cutting head 70 is fixed to the main body 10 at a home position HC (see FIG. 2) to be described below and the carriage 30 moves to the right, the connection between the carriage 30 and the cutting head 70 is released. In this way, the magnet 33 forms a second connecting mechanism that freely detachably couples the carriage 30 with the cutting head 70.

Next, operations of the ink jet printer 1 are described. As described above, the ink jet printer 1 is capable of printing with the ink head 40, and cutting with the cutting head 70.

Figure 7:
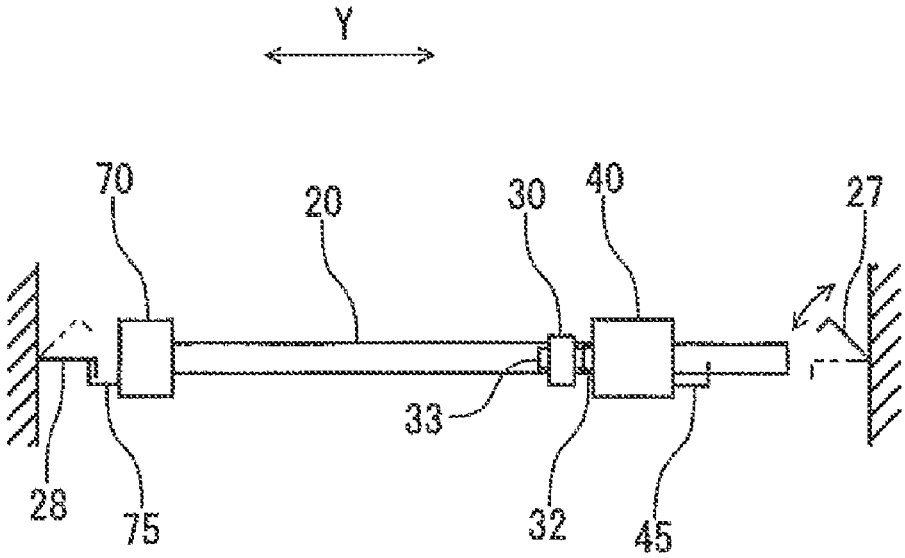
FIG. 7 is a front view illustrating the connection operation of the carriage according to one embodiment.

At the time of printing, the cutting head 70 stands by at the home position HC (see FIG. 2) separated from the carriage 30. According to one embodiment, the left end section inside the main body 10 is the home position for the cutting head 70. As schematically shown in FIG. 7, an engaging member 75 is provided on the cutting head 70, and an engaging member 28, which can engage with and disengage from the engaging member 75 of the cutting head 70, is provided at the left end section of the main body 10. At the end of a cut-out process, the cutting head 70 is carried to the home position HC by the carriage 30. When the cutting head 70 reaches the home position HC, the engaging member 28 goes from a disengaged state (i.e., a state indicated by a dotted line in FIG. 7) to an engaged state (i.e., a state indicated by a solid line in FIG. 7), so that it engages with the engaging member 75 of the cutting head 70. When the carriage 30 moves to the right in this state, the carriage 30 separates from the cutting head 70 against the magnetic force of the magnet 33 provided on the carriage 30. As a result, the cutting head 70 remains at the home position HC and stands by at the home position HC.

At the time of printing, the ink head 40 is connected to the carriage 30. The connection of the carriage 30 to the ink head 40 takes place at the home position HP for the ink head 40. According to the present embodiment, the right end section inside the main body 10 is the home position for the ink head 40.

A cap is provided at the lower side of the right end section inside the main body 10. When the ink head 40 stands by at the home position HP, it is positioned above the cap. At least the print heads 41 of the ink head 40 are covered from below by the cap. This suppresses drying of the ink in the print heads 41.

As shown in FIG. 2, a container 16 opened upward and a wiper 17 are disposed between the platen 25 and the cap. The container 16 serves to hold ink discharged from the print head 41. The ink inside the print head 41 increases in viscosity when it comes into contact with air. However, there is a possibility that the discharge performance (or behavior) of the ink head 40 may change if the ink viscosity were to increase. For this reason, the ink head 40 performs an operation to discharge ink towards the container 16 suitably to improve the reliability of its discharge performance. The container 16 is provided for collecting the ink discharged from the ink head 40 during such operations. The wiper 17 serves to clean nozzle surfaces of the print heads 41. When the ink head 40 passes over the wiper 17, the print heads 41 are suitably wiped by the wiper 17, thereby removing unnecessary ink and the like adhered to the print heads 41.

It is noted that, in accordance with the present embodiment as described above, the home position HP for the ink head 40 is provided at the right end section inside the main body 10. However, the positions of the home position HC for the cutting head 70 and of the home position HP for the ink head 40 may be reversed. That is, the home position HC for the cutting head 70 may be provided at the right end section inside the main body 10, while the home position HP for the ink head 40 may be provided at the left end section inside the main body 10.

When the carriage 30 moves to the right along the guide rail 20 while the ink head 40 stands by at the home position HP, the magnet 32 provided on the carriage 30 eventually comes into contact with the connection member 47 of the ink head 40, so that the carriage 30 and the ink head 40 become connected to each other through the magnet 32. As shown in FIG. 7, an engaging member 45 is provided on the ink head 40, while an engaging member 27, which can engage with and disengage from the engaging member 45, is provided at the right end section of the main body 10. In FIG. 7, the belt 23 and the ultraviolet light LEDs 51 and 52 are not shown. At the time of printing, the engaging member 27 is in a disengaged state (shown in a solid line in FIG. 7), which releases the engagement between the engaging member 45 provided on the ink head 40 and the engaging member 27 of the main body 10. As a result, when the carriage 30 moves in the primary scanning direction Y, the ink head 40 moves in the primary scanning direction Y along with the carriage 30.

The ink head 40 ejects ink toward the recording paper 5 while reciprocally moving in the primary scanning direction Y. The recording paper 5 is transferred by the rollers 26 in the auxiliary scanning direction X, in coordination with the reciprocal movements of the ink head 40. For example, as the ink head 40 is moved from one side to the other side in the primary scanning direction Y, the recording paper 5 is transferred forward by a predetermined length; as the ink head 40 is reversed and moved from the other side to the one side, the recording paper 5 is again transferred forward by a predetermined length, and then similar operations are repeated. By these operations, a two-dimensional image and the like are formed on the recording paper 5. Also, the ultraviolet light LEDs 51 and 52 suitably emit light in coordination with the movements of the ink head 40 in the primary scanning direction Y. By this, ultraviolet light is irradiated on the ink droplets discharged on the recording paper 5. Then, the ink droplets on the recording paper 5 is cured, and fixed on the recording paper 5.

During a cut-out process, the ink head 40 stands by at the home position HP separated from the carriage 30. When the printing operation is finished, the ink head 40 is carried by the carriage 30 to the home position HP. When the ink head 40 reaches the home position HP, the engaging member 27 goes from a disengaged state (i.e., a state indicated by a solid line in FIG. 7) to an engaged state (i.e., a state indicated by a dotted line in FIG. 7), so that it engages with the engaging member 45 of the ink head 40. When the carriage 30 moves to the left in this state, the carriage 30 separates from the ink head 40 against the magnetic force of the magnet 32 provided on the carriage 30. As a result, the ink head 40 remains at the home position HP and stands by at the home position HP.

During the cut-out process, the cutting head 70 is connected to the carriage 30. The connection between the carriage 30 and the cutting head 70 takes place at the home position HC for the cutting head 70. When the carriage 30 moves to the left along the guide rail 20 while the cutting head 70 stands by at the home position HC, the magnet 33 provided on the carriage 30 eventually comes into contact with the cutting head 70, so that the carriage 30 and the cutting head 70 become connected to each other through the magnet 33. In the cut-out process, the engaging member 28 is in a disengaged state, which releases the engagement between the engaging member 75 provided on the cutting head 70 and the engaging member 28 of the main body 10. As a result, when the carriage 30 moves in the primary scanning direction Y, the cutting head 70 moves in the primary scanning direction Y along with the carriage 30.

When the cutting head 70 moves to a predetermined position on the recording paper 5, the cutter 72 of the cutting head 70 (see FIG. 6) descends and cuts into the recording paper 5. As the cutting head 70 moves in the primary scanning direction Y, while the cutter 72 cuts the recording paper 5, the recording paper 5 is transferred by the rollers 26 in the auxiliary scanning direction X. This allows the recording paper 5 to be cut in a predetermined shape.

The carriage 30 connected to either the ink head 40 or the cutting head 70 is controlled to reciprocate between a first return position P1 (see FIG. 2) located at the left end side of the guide rail 20 and a second return position P2 located at the right end side of the guide rail 20. However, the first return position P1 and the second return position P2 shown in FIG. 2 are just one example. The first return position P1 and the second return position P2 are not limited to the positions shown in FIG. 2.

As described earlier, the first ultraviolet light LED 51 and the second ultraviolet light LED 52 are controlled by the control device 35 when a printing operation takes place. According to one embodiment, the control device 35 controls the ultraviolet light LEDs 51 and 52 based on the connection state between the carriage 30 and the ink head 40, the connection state between the carriage 30 and the cutting head 70, and the position of the ink head 40 in the primary scanning direction Y, and the like.

For the control device 35 to control the ultraviolet light LEDs 51 and 52, the connection state between the carriage 30 and the ink head 40 is detected. A mechanism for detecting the connection state between the carriage 30 and the ink head 40 is not particularly limited, but a mechanism such as that described below is used according to one embodiment.

Figure 8:
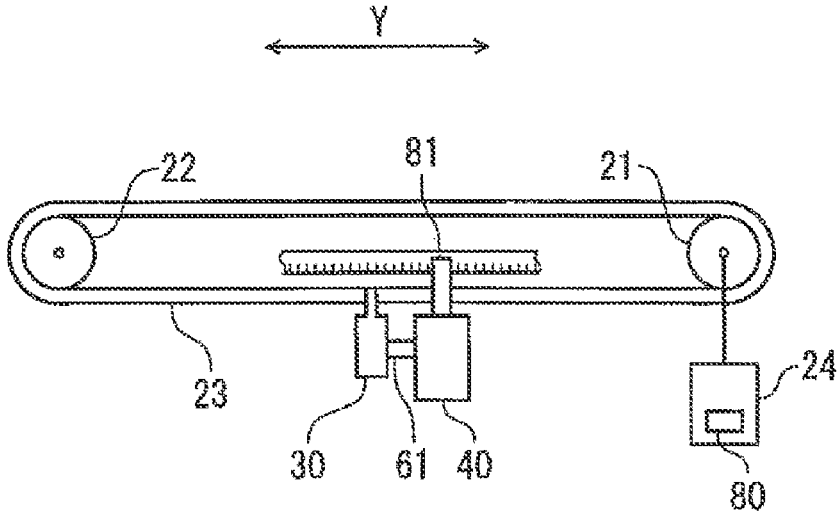
FIG. 8(*a*) is a conceptual diagram showing a mechanism for detecting the positions of the carriage and the ink head according to one embodiment.
Figure 8:
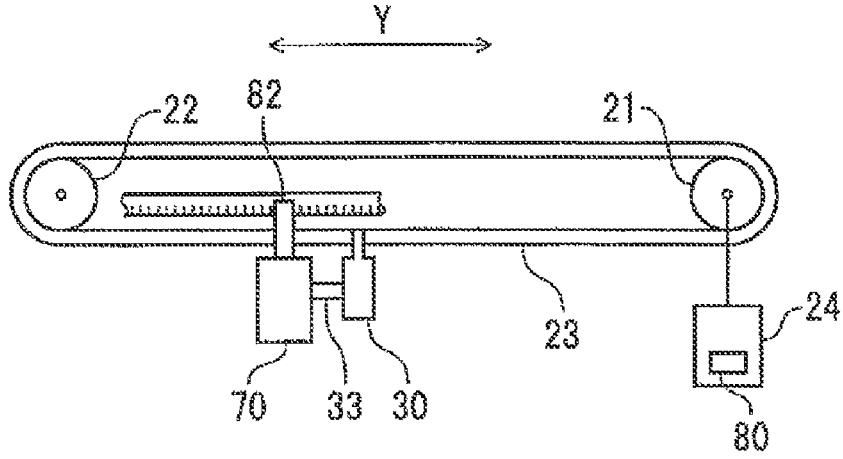

As the pattern diagram in FIG. 8(*a*) shows, a rotary encoder 80 is provided on the servo motor 24, and a linear encoder 81 is provided on the ink head 40. There is an unambiguous relationship between the rotational position of the servo motor 24 and the position of the carriage 30 in the primary scanning direction Y. Accordingly, once the rotational position of the servo motor 24 is found, the position of the carriage 30 becomes unambiguously specified. According to one embodiment, the position of the carriage 30 is detected by the rotary encoder 80. The position of the ink head 40 in the primary scanning direction Y is detected by the linear encoder 81. In this way, the ink jet printer 1 is equipped with a mechanism for detecting the position of the carriage 30 and a mechanism for detecting the position of the ink head 40.

When the carriage 30 and the ink head 40 are connected, the ink head 40 moves with the movement of the carriage 30. Consequently, a state in which the position of the carriage 30 changes and the position of the ink head 40 changes is a state in which the carriage 30 and the ink head 40 are connected. Conversely, when the carriage 30 and the ink head 40 are not connected, the ink head 40 does not move even when the carriage 30 moves. Consequently, a state in which the position of the carriage 30 changes but the position of the ink head 40 does not change is a state in which the carriage 30 and the ink head 40 are not connected. As a result, the connection state between the carriage 30 and the ink head 40 can be detected based on the change in the position of the carriage 30 and the change in the position of the ink head 40.

Figure 9:
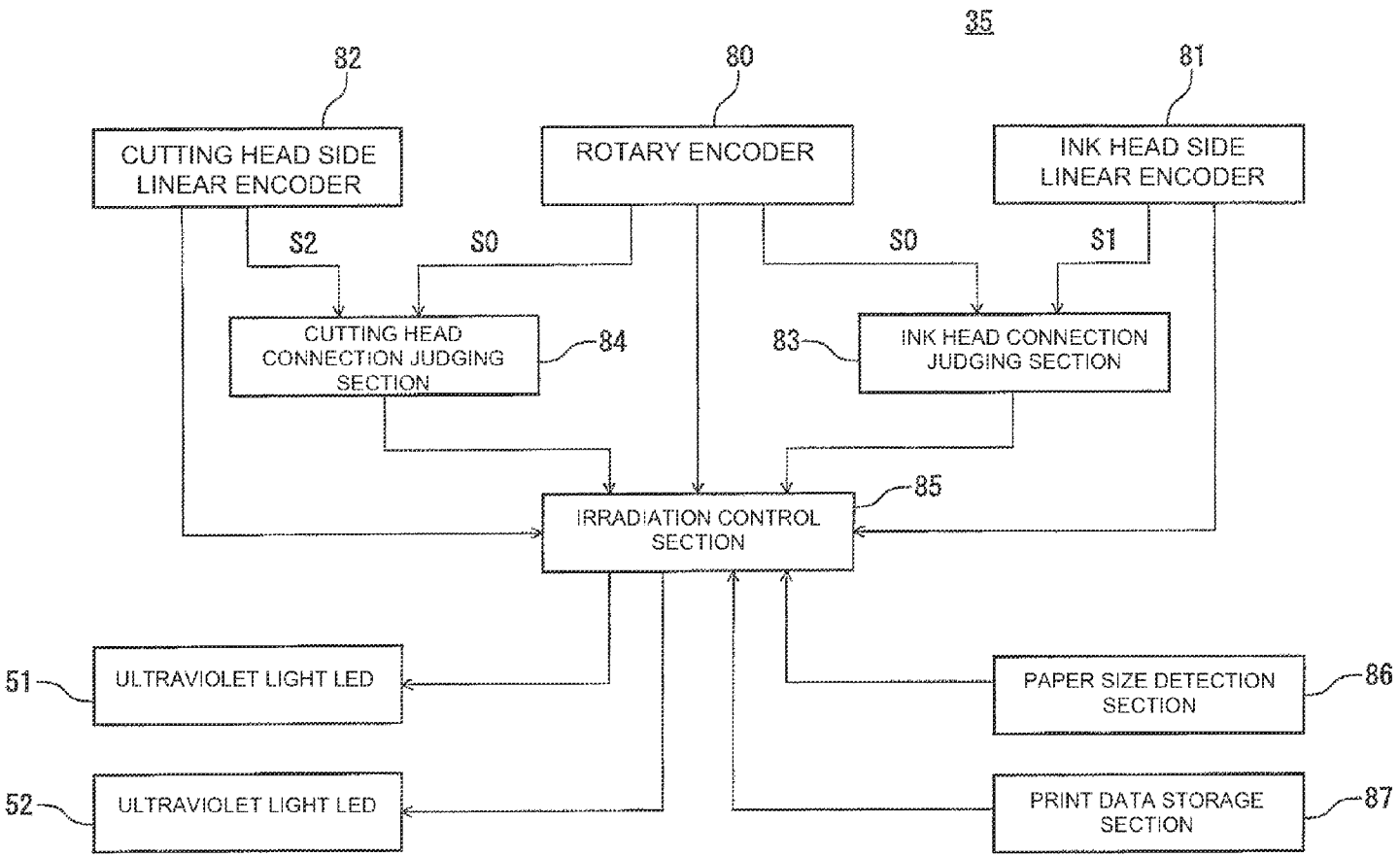
FIG. 9 is a block diagram of a control device relating to the control of an ultraviolet light LED according to one embodiment.

As shown in FIG. 9, the control device 35 is equipped with an ink head connection judging section 83 that judges the connection state between the carriage 30 and the ink head 40. The ink head connection judging section 83 receives a signal S0 from the rotary encoder 80 and a signal S1 from the linear encoder 81. The signal S0 is a signal that specifies the position of the carriage 30, while the signal S1 is a signal that specifies the position of the ink head 40. The ink head connection judging section 83 detects changes in the positions of the carriage 30 and the ink head 40 based on the signals S0 and S1, respectively, and judges the connection state between the carriage 30 and the ink head 40 based on those changes.

In this way, a mechanism for detecting the connection state between the carriage 30 and the ink head 40 includes the rotary encoder 80, the linear encoder 81, and the ink head connection judging section 83 according to one embodiment. The mechanism for detecting the connection state according to the present embodiment indirectly detects the connection state between the carriage 30 and the ink head 40. However, a mechanism for detecting the connection state between the carriage 30 and the ink head 40 is not limited to the mechanism described above. For example, a mechanism for detecting their connection state may include a sensor that directly detects the connection state between the carriage 30 and the ink head 40.

A mechanism for detecting the connection state between the carriage 30 and the cutting head 70 is similar to the mechanism described above. As schematically shown in FIG. 8(*b*), the cutting head 70 is also provided with a linear encoder 82. The position of the cutting head 70 in the primary scanning direction Y is detected by the linear encoder 82. A state in which the position of the carriage 30 changes and the position of the cutting head 70 changes is a state in which the carriage 30 and the cutting head 70 are connected. A state in which the position of the carriage 30 changes but the position of the cutting head 70 does not change is a state in which the carriage 30 and the cutting head 70 are not connected. As a result, the connection state between the carriage 30 and the cutting head 70 can be detected based on the change in the position of the carriage 30 and the change in the position of the cutting head 70.

As shown in FIG. 9, the control device 35 is equipped with a cutting head connection judging section 84 that judges the connection state between the carriage 30 and the cutting head 70. The cutting head connection judging section 84 receives the signal S0 from the rotary encoder 80 and a signal S2 from the linear encoder 82. The signal S2 is a signal that specifies the position of the cutting head 70. The cutting head connection judging section 84 detects changes in the positions of the carriage 30 and the cutting head 70 based on the signals S0 and S2, respectively, and judges the connection state between the carriage 30 and the cutting head 70 based on those changes.

In this way, in accordance with one embodiment, a mechanism for detecting the connection state between the carriage 30 and the cutting head 70 is formed of the rotary encoder 80, the linear encoder 82, and the cutting head connection judging section 84. The mechanism for detecting the connection state according to the present embodiment indirectly detects the connection state between the carriage 30 and the cutting head 70. However, a mechanism for detecting the connection state between the carriage 30 and the cutting head 70 is also not limited to the mechanism described above. For example, a mechanism for detecting their connection state may be formed of a sensor that directly detects the connection state between the carriage 30 and the cutting head 70.

As shown in FIG. 9, the control device 35 is equipped with an irradiation control section 85 for controlling the ON/OFF states of the ultraviolet light LEDs 51 and 52. Next, the control of the ultraviolet light LEDs 51 and 52 performed by the irradiation control section 85 shall be described.

The irradiation control section 85 receives a judging result from the ink head connection judging section 83, and controls the ON/OFF states of the ultraviolet light LEDs 51 and 52 based on the judging result. Specifically, when the ink head connection judging section 83 judges that the carriage 30 is not connected to the ink head 40, the irradiation control section 85 performs a control to prohibit the ultraviolet light LEDs 51 and 52 from emitting light. In this situation, the control device 35 functions as an irradiation prohibiting mechanism that prohibits an irradiation of ultraviolet light when the carriage 30 is not connected to the ink head 40. Through this, the ultraviolet light LEDs 51 and 52 do not emit light when the ink head 40 is not connected to the carriage 30.

The irradiation control section 85 also receives a judging result from the cutting head connection judging section 84, and controls the ON/OFF states of the ultraviolet light LEDs 51 and 52 based on the judging result. Specifically, when the cutting head connection judging section 84 judges that the carriage 30 is connected to the cutting head 70, the irradiation control section 85 performs a control to prohibit the ultraviolet light LEDs 51 and 52 from emitting light. Through this, the ultraviolet light LEDs 51 and 52 do not emit light when the cutting head 70 is connected to the carriage 30.

When the cutting head 70 is not carried by the carriage 30, the cutting head 70 is positioned at the home position HC, and, when the cutting head 70 is carried by the carriage 30, the cutting head 70 is not positioned at the home position HC. Consequently, the cutting head connection judging section 84 is also a part that judges whether or not the cutting head 70 is positioned at the home position HC. As a result, the control described above for turning the ultraviolet light LEDs 51 and 520N/OFF based on the judging result of the cutting head connection judging section 84 is a control for turning the ultraviolet light LEDs 51 and 520N/OFF based on whether or not the cutting head 70 is positioned at the home position HC. In other words, the irradiation control section 85 controls to prohibit the ultraviolet light LEDs 51 and 52 from emitting light when the cutting head 70 is not at the home position HC. In this instance, the control device 35 functions as the irradiation prohibiting mechanism that prohibits an irradiation of ultraviolet light when the cutting head 70 is not at the home position HC.

In the ink jet printer 1, a device that takes a relatively long time to turn ON/OFF, e.g., a halogen lamp and the like, can be used instead of the ultraviolet light LEDs 51 and 52 as the ultraviolet light irradiation device. A certain amount of time is required for the carriage 30 to attach to and detach from the ink head 40 or the cutting head 70, and from the time the carriage 30 becomes connected to the ink head 40 or the cutting head 70 to the time it begins to move. For this reason, the control described above is applicable to situations where a halogen lamp and/or the like is used as the ultraviolet light irradiation device. The ultraviolet light irradiation device subject to the control described above is not limited to the ultraviolet light LEDs 51 and 52.

In comparison, the ultraviolet light LEDs 51 and 52 are characterized by a shorter time to turn ON/OFF compared to halogen lamps and the like. In other words, it is possible to instantaneously turn ON/OFF with the ultraviolet light LEDs 51 and 52. By taking advantage of the characteristic of the ultraviolet light LEDs 51 and 52 described above, a control described below may be executed.

As described earlier, the position of the ink head 40 can be detected according to the ink jet printer 1 of embodiments of the present invention. While the position of the ink head 40 is directly detected by the linear encoder 81, the position of the ink head 40 can also be indirectly detected based on the position of the carriage 30, which can be detected by the rotary encoder 80. However, it shall be assumed in the description below that the position of the ink head 40 is detected by the linear encoder 81.

The first ultraviolet light LED 51 is connected to the ink head 40 through the connection member 43, and the second ultraviolet light LED 52 is connected to the ink head 40 through the connection member 44. The positions of the ultraviolet light LEDs 51 and 52 relative to the ink head 40 are both constant. For this reason, the positions of the ultraviolet light LEDs 51 and 52 can be detected based on the position of the ink head 40. According to one embodiment, the respective positions of the ultraviolet light LEDs 51 and 52 are detected based on the position of the ink head 40 that is detected by the linear encoder 81.

The position of the recording paper 5 in the primary scanning direction Y as placed on the platen 25 is determined in advance by the size of the recording paper 5. Different sizes of the recording paper 5 result in different positions in the primary scanning direction Y for the recording paper 5 relative to the platen 25. The size of the recording paper 5 can be easily recognized by, for example, a user inputting the size of the recording paper 5 using the operation panel 12 (see FIG. 1). Alternatively, a sensor or the like for detecting the size of the recording paper 5 can be separately provided. Here, the part of the control device 35 for detecting the size of the recording paper 5 shall be a paper size detecting section 86 (see FIG. 9).

The irradiation control section 85 receives information regarding the size of the recording paper 5 from the paper size detecting section 86. The irradiation control section 85 also detects the positions of the ultraviolet light LEDs 51 and 52 based on the signal from the linear encoder 81. Moreover, the irradiation control section 85 calculates the respective positions of the ultraviolet light LEDs 51 and 52 relative to the recording paper 5, so that it prohibits the ultraviolet light LED 51 from emitting light when the ultraviolet light LED 51 is not positioned above the recording paper 5 and prohibits the ultraviolet light LED 52 from emitting light when the ultraviolet light LED 52 is not positioned above the recording paper 5. In other words, the irradiation control section 85 performs controls such that the ultraviolet light LED 51 or 52 does not emit light when the ultraviolet light LED 51 or 52 is not in a position opposing the recording paper 5. In this situation, the control device 35 functions as a light emission prohibiting mechanism that prohibits the ultraviolet light LEDs 51 and 52 from emitting light when they are not in positions opposing the recording paper 5.

Figure 10:
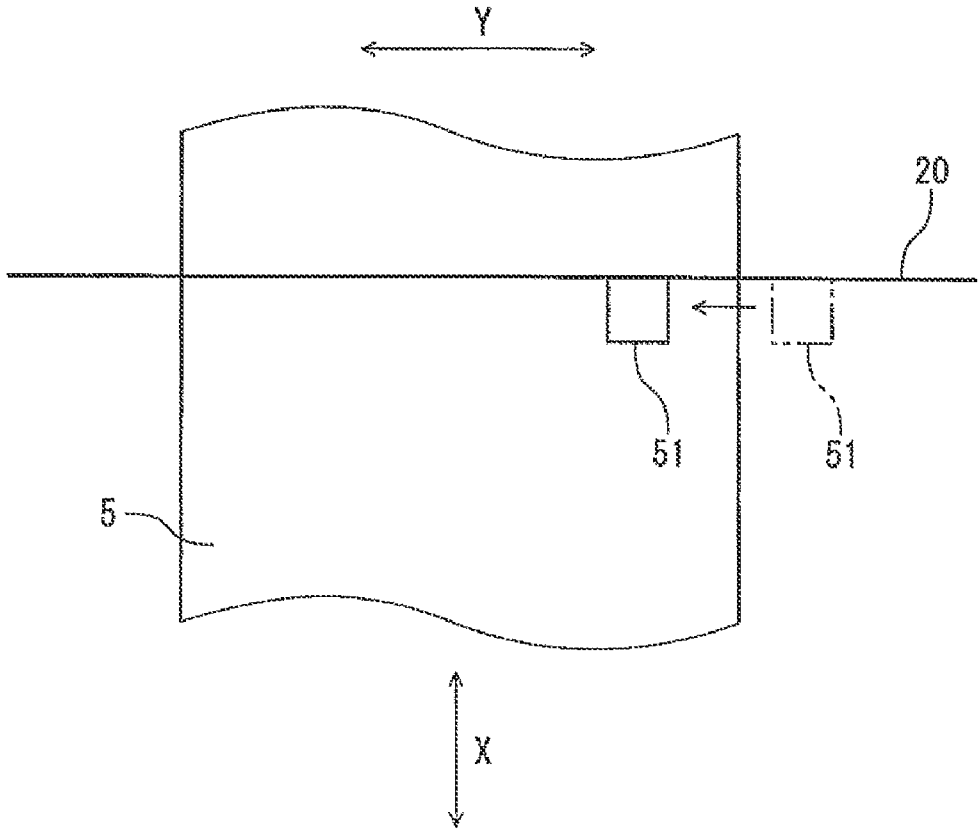
FIG. 10 is a plan view showing the relative positions of the ultraviolet light LED and a sheet of recording paper according to one embodiment.

With the control described above, as shown in FIG. 10, the ultraviolet light LED 51 is instantaneously switched from an OFF state to an ON state between the time the ultraviolet light LED 51 shifts from a position not above the recording paper 5 (a position indicated by dotted lines in FIG. 10) to a position above it (a position indicated by solid lines in FIG. 10). Conversely, when the ultraviolet light LED 51 shifts away from a position above the recording paper, it is instantaneously switched from an ON state to an OFF state.

Figure 11:
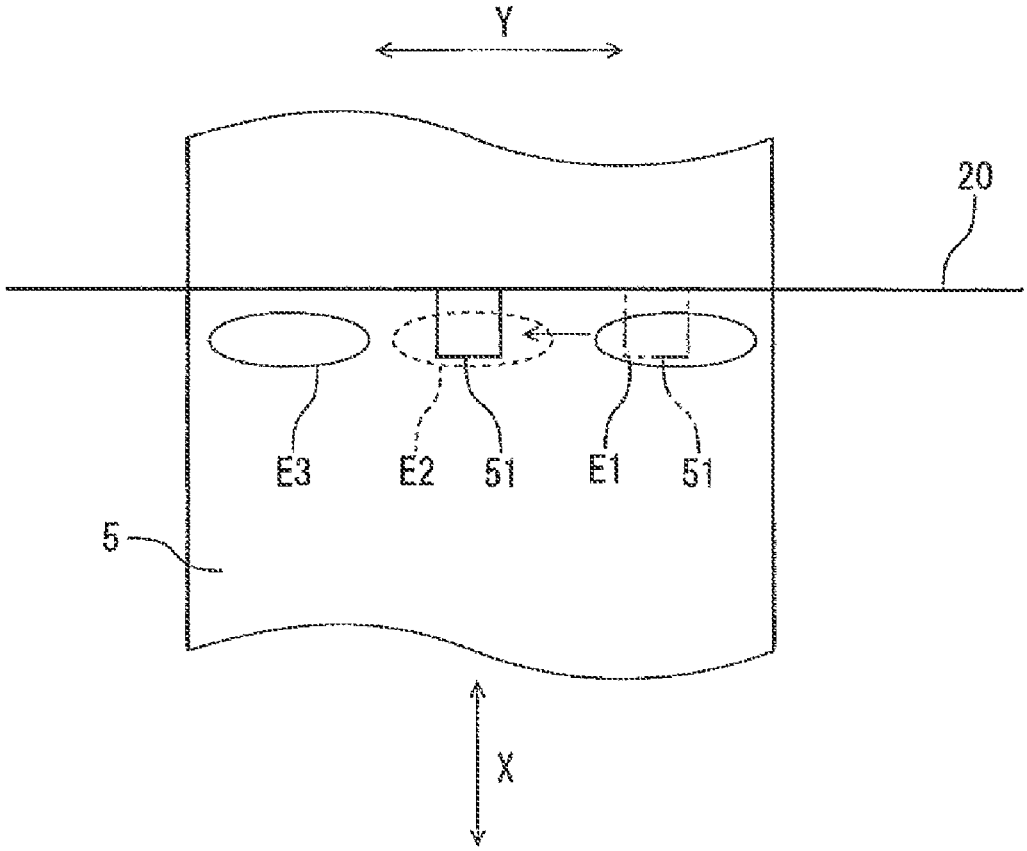
FIG. 11 is a plan view showing the relative positions of the ultraviolet light LEDs and landing regions of the ultraviolet light curable ink on a sheet of recording paper according to one embodiment.

Furthermore, a control described below is also possible with the ink jet printer 1 according to embodiments of the present invention. Depending on the image to be printed, there are situations where the ultraviolet light curable ink is not allowed to land in predetermined regions of the recording paper 5. In other words, there are situations such as shown in FIG. 11, where the ultraviolet light curable ink is allowed to land in predetermined regions E1 and E3, but not in a predetermined region E2. The irradiation control section 85 can prohibit the ultraviolet light LEDs 51 and 52 from emitting light even if their positions are above the recording paper, as long as their positions are above the region E2 where the ultraviolet light curable ink did not land.

The control device 35 performs printing based on print data inputted externally to the ink jet printer 1. The print data includes data on regions for landing and not landing the ultraviolet light curable ink. The irradiation control section 85 receives print data from a print data storage section 87 (see FIG. 9) that stores the print data, and individually prohibits the ultraviolet light LEDs 51 and 52 from emitting light when either the ultraviolet light LED 51 or 52 is positioned above regions where the ultraviolet light curable ink did not land. In other words, the irradiation control section 85 performs a control such that the ultraviolet light LED 51 or 52 does not emit light when the ultraviolet light LED 51 or 52 is not in a position opposing the ultraviolet light curable ink on the recording paper 5. In this situation, the control device 35 functions as the light emission prohibiting mechanism that prohibits the ultraviolet light LEDs 51 and 52 from emitting light when they are not in positions opposing the ultraviolet light curable ink on the recording paper 5.

With the control described above, as shown for example in FIG. 11, the ultraviolet light LED 51 is instantaneously switched from an ON state to an OFF state when the ultraviolet light LED 51 shifts from a position above the landing region E1 of the ultraviolet light curable ink to reach a position above the non-landing region E2, and is instantaneously switched from an OFF state to an ON state when it shifts from a position above the non-landing region E2 to reach the landing region E3.

As described above, in the ink jet printer 1 according embodiments of the present invention, the carriage 30 carries the ink head 40 without the cutting head 70 when printing, and the cutting head 70 without the ink head 40 when cutting. For this reason, the load on the carriage can be reduced.

Further according to embodiments of the present invention, the control device 35 detects whether or not the carriage 30 is connected to the ink head 40, and prohibits the ultraviolet light LEDs 51 and 52 from emitting light when the carriage 30 is not connected to the ink head 40. Additionally, the control device 35 detects whether or not the cutting head 70 is at the home position HC, and prohibits the ultraviolet light LEDs 51 and 52 from emitting light when the cutting head 70 is not at the home position HC. This results in preventing unnecessary ultraviolet light irradiation. Consequently, operational efficiency can be improved. Furthermore, since no extra ultraviolet light is irradiated on unnecessary portions, this prevents curing any unnecessary portions.

The timing for prohibiting the ultraviolet light LEDs 51 and 52 from emitting light (hereafter referred to as a "light emission prohibiting timing") does not necessarily have to be similar to timings described previously. The light emission prohibiting timing may be the moment the carriage 30 separates from the ink head 40, or it may be a predetermined amount of time before or after that moment. For example, the ultraviolet light LEDs 51 and 52 may be prohibited from emitting light after a short time (1 second, for example) has passed after the carriage 30 separates from the ink head 40. Alternatively, prohibiting the ultraviolet light LEDs 51 and 52 from emitting light may begin shortly (1 second, for example) before the time the carriage 30 is scheduled to separate from the ink head 40 (this time can be predicted based on a control program or the like in the ink jet printer 1). The timing for separating the carriage 30 from the ink head 40 and the light emission prohibiting timing do not necessarily have to be strictly linked. The control device 35 is not limited by the embodiment described above and can prohibit the ultraviolet light LEDs 51 and 52 from emitting light based on a predetermined condition related to the connection state between the carriage 30 and the ink head 40 through the first connecting mechanism 61.

The light emission prohibiting timing may be the moment the cutting head 70 positions itself away from the home position HC, or it may be a predetermined amount of time before or after that moment. For example, the ultraviolet light LEDs 51 and 52 may be prohibited from emitting light after a short time (1 second, for example) has passed after the cutting head 70 positions itself away from the home position HC. Alternatively, prohibiting the ultraviolet light LEDs 51 and 52 from emitting light may begin shortly (1 second, for example) before the time the cutting head 70 is scheduled to position itself away from the home position HC (this time can be predicted based on a control program and the like in the ink jet printer 1). The timing for the cutting head 70 to position itself away from the home position HC and the light emission prohibiting timing do not necessarily have to be closely related. The control device 35 is not limited by the embodiment described above and can prohibit the ultraviolet light LEDs 51 and 52 from emitting light based on a predetermined condition related to the position of the cutting head 70.

Additionally, the control device 35 can detect the positions of the ultraviolet light LEDs 51 and 52 relative to the recording paper 5 and prohibit the ultraviolet light LEDs 51 and 52 from emitting light when the ultraviolet light LEDs 51 and 52 are not in positions opposing the recording paper 5. This would result in even further prevention of unnecessary irradiation.

The control device 35 can further detect the positions of the ultraviolet light LEDs 51 and 52 relative to the ultraviolet light curable ink on the recording paper 5 and prohibit the ultraviolet light LEDs 51 and 52 from emitting light when the ultraviolet light LEDs 51 and 52 are not in positions opposing the ultraviolet light curable ink on the recording paper 5. This would result in even greater prevention of unnecessary irradiation.

Figure 12:
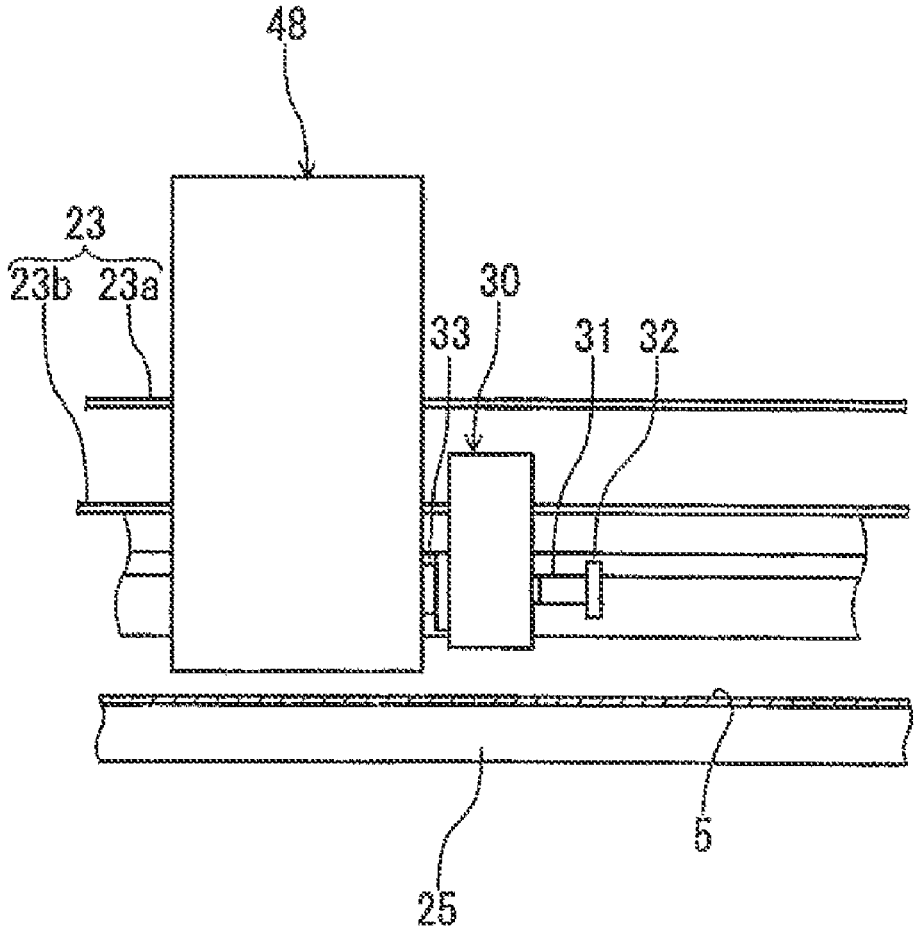
FIG. 12 is a front view of the carriage and another ink head according to one embodiment.

According to the embodiment described above, of the plurality of heads provided on the ink jet printer 1, a head other than the ink head 40 for discharging the ultraviolet light curable ink is the cutting head 70. However, heads other than the ink head 40 for discharging the ultraviolet light curable ink are not limited to the cutting head 70. As shown for example in FIG. 12, another head may be an ink head 48 for discharging an ink different from the ultraviolet light curable ink. With this, effects described earlier can be gained in an ink jet printer that can print with the ultraviolet light curable ink as well as other types of ink.

According to the embodiments described above, the two ultraviolet light LEDs 51 and 52 are mounted on the ink head 40. However, the number of ultraviolet light irradiation devices that move with the ink head 40 in the primary scanning direction Y may be one.

In embodiments described herein, a "recording medium" may refer to a medium where characters or images or the like can be formed by having ink adhere on its surface or in its interior, and its material is not particularly limited. Materials for the recording medium may be, for example, paper, resin, aluminum, iron, wood, and the like. Furthermore, the shape of the recording medium is neither limited in any way. Recording media may include sheet-like media, such as, sheets of paper, vinyl sheets, resin sheets, and the like. Moreover, substrates of glass plate and the like are included among the recording media.

The "home position" for the head does not necessarily have to be a fixed position, and it may be an arbitrary position within a fixed region. The term "home position" includes both a fixed position or a fixed region of positions. For example, the position where the head is disconnected from the carriage, the position where the head stands by, and the position where the head is connected to the carriage may be positions within a predetermined region, and they do not have to be the same.

The foregoing embodiments and advantages are merely exemplary and are not to be construed as limiting the present invention. The present teaching can be readily applied to other types of apparatuses and processes. The description of embodiments of the present invention is intended to be illustrative, and not to limit the scope of the claims. Many alternatives, modifications, and variations will be apparent to those skilled in the art.

What is claimed is:

1. An ink jet recording apparatus comprising:

a guide rail extending in a first direction;

an ink head that slidably engages with the guide rail and discharges an ultraviolet light curable ink toward a recording medium;

an ultraviolet light irradiation device that is attached to the ink head to move together with the ink head and that irradiates ultraviolet light to the ultraviolet light curable ink discharged from the ink head onto the recording medium;

a second head that slidably engages with the guide rail;

a carriage that moves along the guide rail;

a first connection mechanism that detachably connects the carriage with the ink head;

a second connection mechanism that detachably connects the carriage with the second head; and an irradiation prohibition mechanism that prohibits the irradiation by the ultraviolet light irradiation device based on a predetermined condition relating to a connection state between the carriage and the ink head caused by the first connection mechanism, wherein the irradiation prohibition mechanism detects whether the first connection mechanism connects the carriage with the ink head, and prohibits the irradiation by the ultraviolet light emitting device upon detecting that the first connection mechanism does not connect the carriage with the ink head.

2. The ink jet recording apparatus according to claim 1, wherein the ultraviolet light emitting device is an ultraviolet light emitting diode.

3. The ink jet recording apparatus according to claim 2, further comprising a light emission prohibition mechanism that detects a position of the ultraviolet light emitting diode with respect to the recording medium, and prohibits light emission by the ultraviolet light emitting diode when the ultraviolet light emitting diode is not at a position opposite the recording medium.

4. The ink jet recording apparatus according to claim 2, further comprising a light emission prohibition mechanism that detects a position of the ultraviolet light emitting diode with respect to the ultraviolet light curable ink discharged from the ink head onto the recording medium, and prohibits light emission by the ultraviolet light emitting diode when the ultraviolet light emitting diode is not at a position opposite the ultraviolet light curable ink on the recording medium.

5. The ink jet recording apparatus according to claim 1, wherein the second head is connected to and disconnected from the carriage at a home position located at an end portion of the guide rail, and stands by at the home position when the second head is not connected to the carriage, and is equipped with an irradiation prohibition mechanism that detects whether the second head is at the home position, and prohibits the irradiation by the ultraviolet light irradiation device when the second head is not at the home position.

6. The ink jet recording apparatus according to claim 1, wherein the ultraviolet light emitting device is an ultraviolet light emitting diode.

7. The ink jet recording apparatus according to claim 6, further comprising a light emission prohibition mechanism that detects a position of the ultraviolet light emitting diode with respect to the recording medium, and prohibits light emission by the ultraviolet light emitting diode when the ultraviolet light emitting diode is not at a position opposite the recording medium.

8. The ink jet recording apparatus according to claim 6, further comprising a light emission prohibition mechanism that detects a position of the ultraviolet light emitting diode with respect to the recording medium, and prohibits light emission by the ultraviolet light emitting diode when the ultraviolet light emitting diode is not at a position opposite the recording medium.

9. The ink jet recording apparatus according to claim 1, wherein the second head is a cutting head that has a cutter and performs a cutting-out process on the recording medium with the cutter.

10. The ink jet recording apparatus according to claim 1, wherein the second head is an ink head that ejects an ink different from the ultraviolet light curable ink toward the recording medium.

11. An ink jet recording apparatus comprising:

a guide rail extending in a first direction;

an ink head that slidably engages with the guide rail, and discharges an ultraviolet light curable ink toward a recoding medium;

an ultraviolet light irradiation device that is attached to the ink head to move together with the ink head and that irradiates ultraviolet light to the ultraviolet light curable ink discharged from the ink head onto the recording medium;

a second head that slidably engages with the guide rail;

a carriage that moves along the guide rail;

a first connection mechanism that detachably connects the carriage with the ink head; and a second connection mechanism that detachably connects the carriage with the second head;

wherein the second head is connected to and disconnected from the carriage at a home position located at an end portion of the guide rail, and stands by at the home position when the second head is not connected to the carriage, and is equipped with an irradiation prohibition mechanism that prohibits the irradiation by the ultraviolet light irradiation device based on a predetermined condition relating to a position of the second head, and wherein the irradiation prohibition mechanism detects whether the second head is at the home position and the second connection mechanism does not connect the carriage with the second head, and prohibits the irradiation by the ultraviolet light irradiation device upon detecting the second head is not at the home position and the second connection mechanism connects the carriage with the second head.

12. The ink jet recording apparatus according to claim 11, wherein the second head is a cutting head that has a cutter and performs a cutting-out process on the recording medium with the cutter.

13. The ink jet recording apparatus according to claim 11, wherein the second head is an ink head that ejects an ink different from the ultraviolet light curable ink toward the recording medium.

* * * * *

UNITED STATES PATENT AND TRADEMARK OFFICE

CERTIFICATE OF CORRECTION

PATENT NO. : 8,262,214 B2
APPLICATION NO. : 12/725400
DATED : September 11, 2012
INVENTOR(S) : Harumichi Doo It is certified that error appears in the above-identified patent and that said Letters Patent is hereby corrected as shown below:

Title Page, Item [73] Assignee, please delete "LG Electronics Inc., Seoul (KR)" and insert --Roland DG Corporation, Hamamatsu-shi (JP)--.

Signed and Sealed this
Sixth Day of November, 2012

David J. Kappos

David J. Kappos
*Director of the United States Patent and Trademark Office*